United States Patent [19]

Amidon et al.

[11] 4,023,968

[45] May 17, 1977

[54] PHOTOELECTROPHORETIC COLOR IMAGING PROCESS IN WHICH BACK MIGRATION IS ELIMINATED

[75] Inventors: Alan B. Amidon; Joseph Mammino, both of Penfield, N.Y.

[73] Assignee: Xerox Corporation, Stamford, Conn.

[22] Filed: Oct. 25, 1972

[21] Appl. No.: 300,532

[52] U.S. Cl. ..... 96/1.3; 96/1 PE; 96/1.2; 96/1.4; 204/181; 355/3 P

[51] Int. Cl.[2] ..... G03G 17/04

[58] Field of Search ..... 96/1 PE, 1.2, 1.3, 1.4; 204/181 PE

[56] References Cited

UNITED STATES PATENTS

| | | | |
|---|---|---|---|
| 3,427,242 | 2/1969 | Mihajlov | 96/1 PE X |
| 3,648,607 | 3/1972 | Gundlach | 96/1 PS X |
| 3,655,370 | 4/1972 | Carreira et al. | 96/1 PE X |
| 3,664,834 | 3/1972 | Amidon et al. | 96/1.5 X |
| 3,705,797 | 12/1972 | Mihajlov et al. | 96/1 PE |
| 3,716,360 | 2/1973 | Fukushima | 96/1 R X |
| 3,791,823 | 2/1974 | Carreira | 96/1.2 X |

*Primary Examiner*—Edward C. Kimlin
*Assistant Examiner*—John R. Miller
*Attorney, Agent, or Firm*—James J. Ralabate; Richard A. Tomlin; Max J. Kenemore

[57] ABSTRACT

In an electrophoretic reproduction process wherein a colored reproduction of an original is obtained by sequentially electrophoretically generating at least two visible monochromatic images, and superimposing said images in registry upon a copy web to form a colored reproduction, an improvement is provided comprising essentially eliminating back migration of marking materials from the copy web to the imaging suspension in the second and subsequent image generating steps by employing, in each instance, marking materials comprising a solvent tackifiable polymer and a colorant and/or a copy web containing a solvent tackifiable polymer, and applying to the copy web at least a partial solvent for said tackifiable polymer in an amount sufficient to render said polymer at least partially tacky before the second and before each subsequent image generating step.

15 Claims, 2 Drawing Figures

PHOTOELECTROPHORETIC COLOR IMAGING PROCESS IN WHICH BACK MIGRATION IS ELIMINATED

This invention relates to electrophoretic reproduction systems. More particularly, this invention relates to improved electrophoretic color reproduction systems wherein the problem of back migration of marking materials is essentially eliminated.

Several electrophoretic reproduction systems have been developed which are useful for monochromatic image reproduction. In these systems, full color imaging or special color effects can be obtained by a method comprising repeating the monochromatic process with a differently colored marking material and superimposing the second and subsequent images upon the initial image. For full color imaging, three color separation images are sequentially formed, each representative of a single primary color component of the original. When the three developed images are superimposed on a copy web, a full color reproduction is obtained.

It has been found that in the second and subsequent sequential electrophoretic imaging steps, both physical and electrical interaction occur between the initial pattern of marking material on the copy web and the second and subsequent patterns of marking materials generated in the second and subsequent electrophoretic imaging steps resulting in back migration and transfer of at least a portion of the initial marking material thereby giving rise to a significant loss of saturation for the first color. Again, when the second and subsequent images are transferred to the copy web, portions of each previous color on the copy web similarly undergo back migration or physical transfer resulting in a total loss of control of color balance, with the final color always being dominant.

In one form of electrophoretic imaging, generally referred to as photoelectrophoretic imaging, colored photosensitive particles are suspended in an insulating carrier liquid. This suspension is then placed between at least two electrodes, subjected to a potential difference and exposed to a light image. Ordinarily, in carrying out the process, the imaging suspension is placed on a transparent electrically conductive support in the form of a thin film and exposure is made through the transparent support while a second generally cylindrically shaped biased electrode is rolled across this suspension. Although not wishing to be bound by any theory or mechanism, it is currently believed that the particles bear an initial charge once suspended in the liquid carrier which causes them to be attracted to the transparent base electrode upon application of a potential difference. Upon exposure, the particles change polarity by exchanging charge with the base electrode so that the exposed particles migrate to the second or roller electrode thereby forming images on each of the electrodes by particle subtraction, each image being complementary, one to the other. An extensive and detailed description of the photoelectrophoretic imaging techniques as generally referred to may be found in U.S. Pat. Nos. 3,383,993; 3,384,488; 3,384,565 and 3,384,566 which are hereby incorporated by reference.

In one embodiment of photoelectrophoretic imaging, full color imaging can be obtained by establishing three photoelectrophoretic printers in series, each one adapted to receive a color separation image and print the image monochromatically but with either a magenta, cyan or yellow pigment, each print being superimposed upon the other to ultimately provide full color synthesis in the final product.

Other photoelectrophoretic processes have been developed in which an imaging suspension comprising a mixture of electrically photosensitive particles and inert particles dispersed in a carrier liquid is placed in an electrical field between electrodes and exposed to imagewise electromagnetic radiation. While the above steps are being completed, images are formed by particle migration on both electrodes. The images are formed by the migration of the photosensitive particles or migration of the inert particles depending upon the polarity of the applied field as described in copending application Ser. No. 104,388, filed Jan. 6, 1971, now U.S. Pat. No. 3,772,013, entitled "Imaging Process" and assigned to the same assignee herein. Said application is incorporated herein by reference. The term "inert particles" refers to those particles which will not, when suspended alone, respond significantly to the levels of radiation used. The inert particles may comprise conductive, semi-conductive and insulating materials and may themselves be electrically photosensitive. Where an electrically photosensitive material is used as the inert material to insure complete separation of the photosensitive material from the inert photosensitive material, the inert material should have a response about one-tenth or less that of the response of the photosensitive material. That is, it should require at least ten times as much exposure to the radiation used to migrate. Since the inert particles useful in this process may comprise, for example, brilliantly colored thermoplastic materials, high quality full color images may be produced by transferring three or more monochromatic images formed by this process to a common substrate in register.

An electrophoretic imaging system has also been developed wherein finely-divided particles dispersed in an insulating liquid are placed between a photoconductive electrode and a second electrode. The photoconductive electrode is exposed to a pattern of radiation to which it responds while a field is applied across the suspension between the photoconductive electrode and the second electrode. The photoconductive electrode causes those particles which are within interaction range of the illuminated parts of said electrode to take on the same sign of charge as the photoconductive electrode and be repelled by it. These repelled particles migrate to the surface of the second electrode in image configuration forming a negative image on the surface of the second electrode and leaving a positive image behind.

The particles which may be dispersed in the insulating liquid may be insulating, semi-conductive or conductive and may comprise two or more components. Since it is essential that the particles be capable of accepting and retaining charge injected from the photoconductive electrode, it has been found desirably that the surface of the particles be made of a material which has a bulk resistivity of at least $10^5$ ohm-cm. and preferably $10^7$ ohm-cm. or greater. There is no known upper limit of operability in that particulate dyed plastics having resistivities of greater than $10^{13}$ ohm-cm. have been found to work very well.

To obtain the greatest advantages of this process where a uniform dispersion of particles in a liquid is used, the dispersed particles are initially forced to the surface of the photoconductive electrode by application of field. For example, where the photoconductive electrode is held at a positive potential with respect to the second electrode during imaging, the suspension is first charged negatively by, for example, a negative corona discharge which causes the particles to take on a negative charge. When the suspension is placed on the positive photoconductive electrode the particles are drawn to the surface of the photoconductive electrode leaving a relatively thick layer of particle-free liquid between the particles and the second electrode. When the photoconductor is exposed to radiation to which it is sensitive, particles which are adjacent to illuminated areas of the photoconductive electrode exchange charge with the photoconductive electrode and migrate through the liquid to the second electrode. When pre-charging is used initially, only liquid contacts the second electrode and, therefore, background is measurably improved. In other words, the only particles which contact the second electrode are those which have migrated there as a result of charge exchange with the photoconductive electrode.

This electrophoretic imaging process is described in copending application Ser. No. 104,389, filed Jan. 6, 1971 now abandoned and replaced by continuation application Ser. No. 290,618, filed Sept. 20, 1972, entitled "Imaging Process" and is assigned to the same assignee as herein. This application is incorporated herein by reference. To produce a full color image with this process, three or more monochromatic images are formed corresponding to color separation images, each in a primary color, and are transferred in register to a single substrate resulting in full color synthesis.

In these electrophoretic processes, charge retaining particles are sequentially placed between electrodes under differing electrical field conditions and polarities, thus giving rise to the problem of back migration or transfer of pigment images between successive color overprinting steps. Each of these processes involve the successive superimposition of at least two monochromatic images (for special color effects) or at least three monochromatic images for full color synthesis, which are obtained by color filter separation from a colored original. In each instance, the fidelity of the color reproduction obtained is relatively poor and difficult to reproduce due to excessive back migration of pigments. Back migration is manifested by the partial back transfer of the first monochromatic image from the copy sheet or transfer web to the second monochromatic imaging suspension during the formation of the second image thereon. Similarly, the first two color images back transfer during the formation of the third image. Back migration results in a total loss of control of color balance, with the final color always dominant.

Accordingly, it is an object of the present invention to provide a process for essentially eliminating back migration in electrophoretic reproduction systems wherein special or full color synthesis is achieved by sequential repetition of a monochromatic imaging process with superimposition of the resulting images to obtain the final colored image.

It is another object of the present invention to provide a process which enables high fidelity color reproduction.

It is still a further object to provide sequential electrophoretic processes for full color imaging with effective control of color balance.

It is yet another object to provide sequential electrophoretic processes for full color imaging with effective control of color balance regardless of whether the imaging particles are electrically photosensitive or inert.

These as well as other objects are accomplished by the present invention which provides an improved electrophoretic reproduction process wherein a colored reproduction of an original is obtained by sequentially electrophoretically generating at least two visible monochromatic images, and superimposing said images in registry upon a copy web to form a colored reproduction, wherein the improvement comprises essentially eliminating back migration of marking materials from the copy web to the imaging suspension in the second and subsequent image generating steps by employing, in each instance, marking materials comprising a solvent tackifiable polymer and a colorant and/or a copy web containing a solvent tackifiable polymer, and applying to the copy web at least a partial solvent for said tackifiable polymer in an amount sufficient to render said polymer at least partially tacky before the second and before each subsequent image generating step.

The present invention will become more apparent upon a reading of the ensuing discussion with reference to the drawing wherein.

Figure 1:
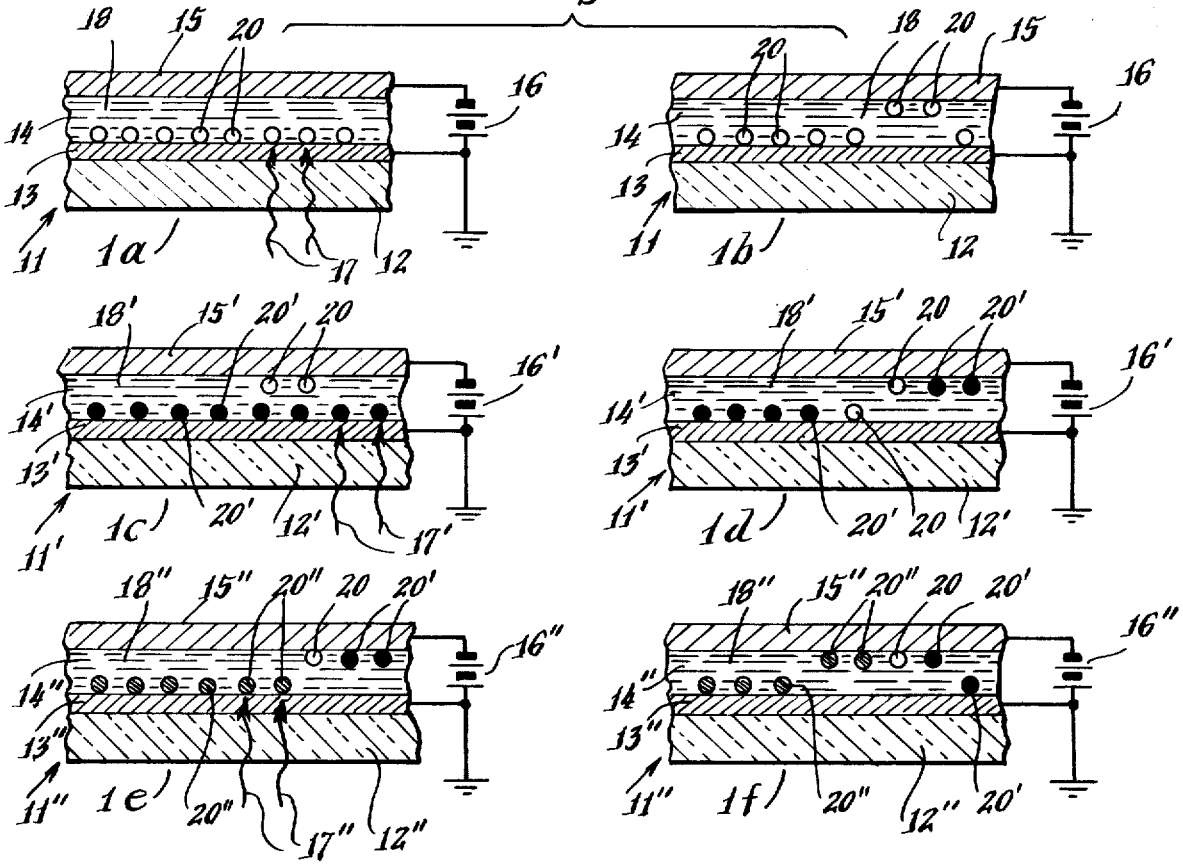
FIG. 1 is a diagrammatic representation of a typical electrophoretic process illustrating the occurrence of back migration.

Referring now to FIG. 1(a) through (f) wherein identical numerals are used to identify identical parts of the apparatus, there is seen a transparent electrode generally designated 11 which, in this exemplary instance, is made up of a layer of optically transparent glass 12 overcoated with a thin optically transparent layer 13 of tin oxide commercially available under the name NESA glass. Coated on the surface of transparent electrode 11 is a thin layer 14 of finely-divided electrically photosensitive particles of one color dispersed in a substantially insulating liquid carrier. Above the layer 14 of liquid suspension is a second electrode 15 which is connected to one side of potential source 16. The opposite side of potential source 16 is connected to the transparent electrode 11 thereby establishing an electric field across the layer 14 between electrodes 11 and 15. An image projector (not shown) comprising a light source, a tranparency and a lens is provided to expose layer 14 to a light image, represented by arrows 17, of the original transparency to be reproduced. The particle dispersion generally identified as 14 consists of the substantially insulating carrier liquid 18 having charged particles 20 suspended therein. The particles 20 bear a net electrostatic charge when suspended in the carrier liquid 18 which is believed to be related to the triboelectric relationship of the particles and liquid. The charges are trapped or bound either within the body of the particles or at their surfaces. The net charge on the particles may be either positive or negative; however, in this instance, each particle has been treated as having a negative charge to diagrammatically indicate that trapped negative charge carriers give that particular particle a net negative electrostatic charge. When no potential is applied across electrodes 11 and 15, the suspended particles 20 merely assume random positions in the liquid carrier 18. However, when potential is applied in the manner shown in FIG. 1(*a*), it renders the conductive surface 13 of electrode 11 positive with respect to the back surface of electrode 15. Negatively charged particles within the system tend to move toward electrode 11 while any positively charged particles in the system would move toward electrode 15. The existence of any positively charged particles within the system and their movement therein will temporarily be disregarded so as to facilitate the explanation of the movement of negatively charged particles in the carrier liquid. Since the particles 20 are, in the absence of actinic radiation, non-conductive, they come down into contact with or closely adjacent to electrode 11 and remain in that position under the influence of the applied electric field until they are subjected to exposure to activating electromagnetic radiation. In effect then, these particles are bound at the surface of the electrode 11 until exposure takes place because particles 20 are sufficiently non-conductive in the suspension in their unexposed condition to prevent the injection of positive charge from the surface 13 of the electrode 11 into them. Particles bound on the surface 13 make up the potential imaging particles for the final image to be reproduced thereon.

When photons of light, shown as arrows, 17, in FIG. 1(*a*) are produced as, for example, by the projector which exposes the system to the image being reproduced, they are absorbed by the photosensitive pigment in particles 20 and "create" hole-electron pairs of charge carriers within the particle by raising them to a conductive energy band. Since an electric field is applied across the particles by the potential applied across electrode 15 and conductive surface 13 of electrode 11, the hole-electron pairs created within these particles are caused to separate before they can recombine, with negative charge carriers moving toward surface 13, while positive charge carriers move up toward electrode 15. Accordingly, all particles such as 20 on the surface 13 which are exposed to electromagnetic radiation of a wavelength to which they are sensitive (that is to say, a wavelength which will cause the formation of hole-electron pairs within the particles) move away from surface 13 up to the surface of electrode 15 leaving behind those particles which are either not exposed at all or not exposed to electromagnetic radiation to which they are sensitive. As shown in FIG. 1(*b*), particles reaching the electrode surface 15 adhere thereto since this surface is relatively insulating and resists injection of charge from the particles. Consequently, if all particles in the system are sensitive to one wavelength of light or another and the system is exposed to an image with that wavelength of light, a positive image will be formed on the surface of electrode 13 by the subtraction of bound particles from its surface in exposed areas leaving behind bound particles in unexposed areas.

The image produced on the surface of electrode 15 is sequentially transferred to a similar electrode 15' of another photoelectrophoretic system shown in FIG. 1*c*. If desired, electrode 15 containing the image thereon can be employed itself as electrode 15'. This second photoelectrophoretic printer comprises a transparent, electrically conductive electrode 11' containing an imaging suspension 14' coated thereon comprising an insulating liquid 18' and photosensitive particles 20' of a different color than particles 20. Upon exposure to a color separation transparency of the original, a light image 17' is generated effecting particle migration of the photoconductive particles in the exposed areas, thereby generating a color separation image on the surface of electrode 15'. Due to electrical interaction between the initial pattern of particles 20 on electrode 15' and the pattern of particles 20' generated in the second imaging process in the presence of the field generated between the electrodes 11' and 15' and also, physical interaction occasioned by contact of the electrodes with the imaging suspension, back migration of at least some particles 20 to electrode 11' occurs as shown in FIG. 1(*d*), giving rise to the loss of saturation of the first color on the ultimate copy.

In a similar manner, FIGS. 1(*e*) and 1(*f*) illustrate further back migration occurring in the third sequential photoelectrophoretic imaging step. Portions of each previous color on the copy web on electrode 15'' can back migrate to electrode 11'' resulting in a loss of control of color balance with the final color always being dominant.

Although the occurrence of back migration has been illustrated with reference to a sequential photoelectrophoretic process, it is apparent that back migration can similarly occur in any sequential electrophoretic process wherein an image on a copy sheet is subjected to the field effects created between the electrodes in subsequent electrophoretic imaging cycles.

Figure 2:
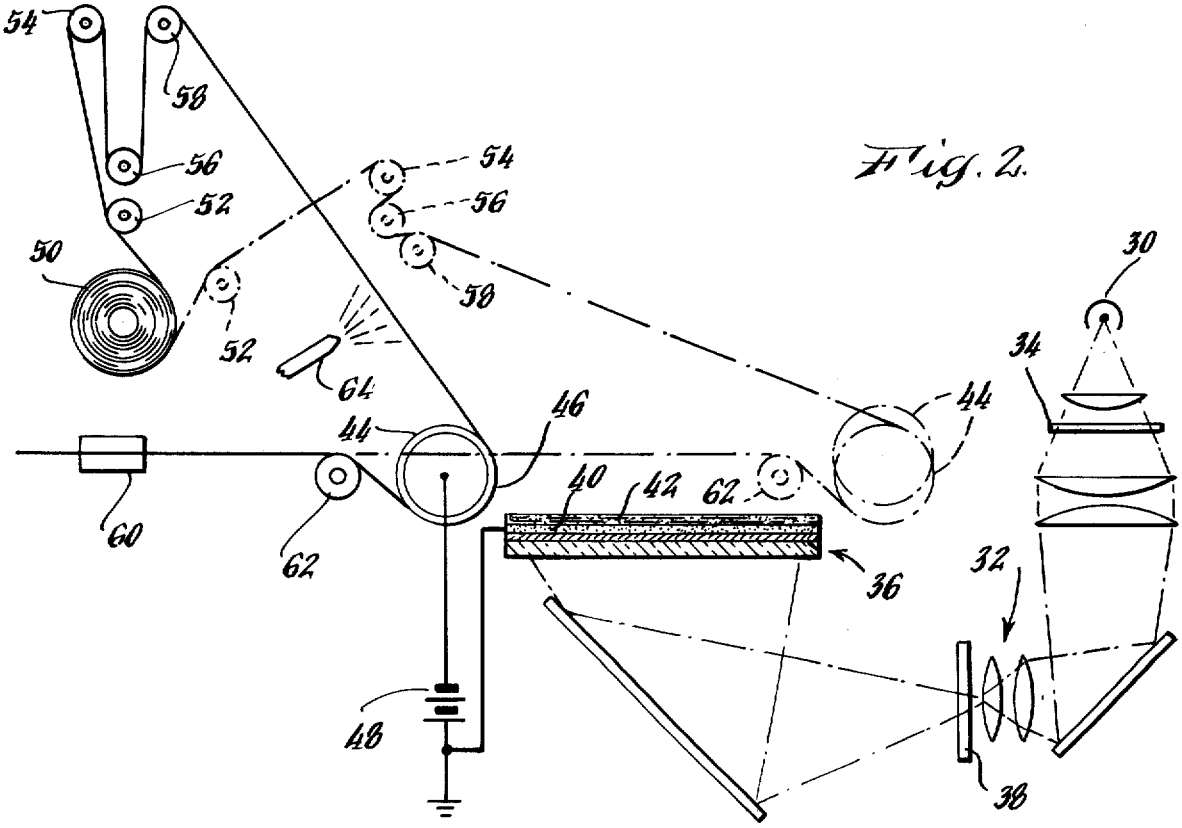
FIG. 2 is a schematic illustration of an embodiment of the present invention enabling the elimination of back migration.

Referring now to FIG. 2, there is illustrated one embodiment of the present invention which essentially eliminates back migration in an electrophoretic imaging process as described in copending U.S. application, Ser. No. 104,389, supra.

In the system shown in FIG. 2, positive full color prints can be obtained from negative transparencies, using three successive color filter separations, with superimposition of the resultant three monochromatic images. A light source 30 such as a 750–1000 volt tungsten projection bulb coupled with an optical system shown generally as 32 is employed to project a negative film transparency 34 onto the underside of a NESA transparent electrically conductive electrode 36. Interposed in the optical path of the light pattern is a holder 38 for color separation filters. The transparent, electrically conductive electrode 36 is overcoated with a photoconductive layer 40. The photoconductive layer 40 can comprise any suitable organic or inorganic photoconductive material. The photoconductor 40 can comprise one or more components and can comprise photoconductive pigments dispersed in photoconductive or inert binders and can be overcoated with, for example, a protective layer of an active transparent layer which is capable of transporting the type of charge carrier which is desired to be imparted to the particles of the imaging suspension 42 which is coated onto the photoconductor 40. An active transparent layer for holes, for example, polyvinyl carbazole may be coated over an evaporated amorphous selenium layer or over a binder structure comprising the *x* form of phthalocyanine or trigonal selenium or a mixture of both in an inert dielectric binder, or contained in a polyvinyl carbazole binder as long as the backing electrode 36 is made positive relative to the opposing electrode 44.

The second opposed electrode 44 can comprise any suitable conductive material. Typical conductive materials include tin oxide coated glass, metals, conductive rubber, carbon black binder dispersions, conductive paper, and the like.

The second electrode 44 preferably has an insulating web 46, over its outer surface to help support the relatively high fields encountered in this process. Typical insulating materials include paper, polymer coated paper such as polyethylene coated paper, polymeric films such as cellulose acetate, nitrocellulose, polystyrene polytetrafluoroethylene, polyurethane, polyesters such as polyethylene terephthalate and the like.

The photoconductive layer 40 is overcoated with an imaging suspension 42 comprising a dispersion of particles in an insulating liquid. The particles which may be dispersed in the insulating liquid may be insulating, semi-conductive or conductive and may comprise two or more components. Since it is essential that the particles be capable of accepting and retaining charge injected from the photoconductive electrode, it has been found desirable that the surface of the particles be made of a material which has a bulk resistivity of at least $10^5$ ohm-cm. and preferably $10^7$ ohm-cm. or greater. There is no known upper limit of operability in that particulate dyed plastics having resistivities of greater than $10^{13}$ ohm-cm. have been found to work very well.

In accordance with this invention, images may be rapidly formed of virtually any particulate material. The particles may be, as stated above, insulating, semiconductive or conductive. For the production of colored images, the particles may advantageously be dyed polymeric materials which are especially suitable for full color transparency or opaque image formation. The advantage of using dyed polymeric materials instead of opaque colored pigments is that brightly colored materials may be made which can be readily fused to form a fixed, final image.

The carrier liquid can comprise any suitable insulating material. Typical insulating liquids include decane, dodecane, tetradecane, kerosene, molten paraffin, molten beeswax or other molten thermoplastic material, mineral oil, silicone oils such as dimethyl polysiloxane, fluorinated hydrocarbons and mixtures thereof. Mineral oil and kerosene are preferred because of their low cost and excellent insulating qualities. Alternatively, the colorant particles may be pre-coated on the photoconductive electrode in a solid binder such as Piccotex polystyrene resin available from Pennsylvania Industrial Chemical Co. or eicosane wax for ease of handling and storage. The binder is melted or dissolved by a dielectric solvent such as those listed above prior to imaging so that the particles are free to migrate from one electrode to another independently of one another Other typical solvent-soluble dielectric binder materials include hydrogenated rosin esters such as Staybelite Esters 5 and 10 available from Hercules Powder Co., phenolformaldehyde resins such as Amberol ST-137-X available form Rohm and Haas, and Piccotex 75 and 100 Piccopale 70 SF available from Pennsylvania Industrial Chemical Co.

It is desirable to use particles of a relatively small size because small particles provide more stable suspensions and provide images of higher resolution than would be possible with larger particles. It is thus preferred that the particles be less than one or two microns in average cross section although particles up to about 45 microns may readily be used. No lower limit on particle size is presently known.

The concentration of particles dispersed in the liquid depends on the density of the final image desired, the use to which the image is to be put and the size of the particles, the solubility of added dispersants, and other factors generally known to those skilled in the art of ink or plastic coating formulation. For example, when finely-divided dyed resinous materials are dispersed in mineral oil or kerosene from about one part by weight to about 50 parts by weight resinous material dispersed in 100 parts liquid provide satisfactory images.

In operation, a color negative such as a Kodacolor slide is projected sequentially through three color separation filters, generally red, green and blue onto a photoconductive electrode sequentially coated with imaging suspensions respectively containing cyan, magenta and yellow colorants in suitable insulating liquids. Superimposition of the cyan, magenta, and yellow images in registration on a copy web such as paper results in the obtainment of a full color image. The images can be generated and superimposed in any order.

The photoconductive electrode 42 causes those particles which are within interaction range of the illuminated parts of the electrode to take on the same sign of charge as the photoconductive electrode and be repelled by it. These repelled particles migrate to the surface of the second electrode 44 in image configuration forming a negative image on the surface of the second electrode and leaving a positive image behind. To obtain the greatest advantages of this invention where a uniform dispersion of particles in a liquid is used, the dispersed particles can be initially forced to the surface of the photoconductive electrode by application of field. For example, where the photoconductive electrode is held at a positive potential with respect to the second electrode during imaging, the suspension is first charged negatively by, for example, a negative corona discharge (not shown) which causes the particles to take on a negative charge. When the suspension is placed on the positive photoconductive electrode, the particles are drawn to the surface of the photoconductive electrode leaving a relatively thick layer of particle-free liquid between the particles and the second electrode. When the photoconductor is exposed to radiation to which it is sensitive, particles which are adjacent to illuminated areas of the photoconductive electrode exchange charge with the photoconductive electrode and migrate through the liquid to the second electrode. The improvement in the process which arises from pre-charging may now be appreciated: when pre-charging is used initially, only liquid contacts the second electrode and, therefore, background is measurably improved. In other words, the only particles which contact the second electrode are those which have migrated there as a result of charge exchange with the photoconductive electrode.

The second electrode 44 can be conveniently formed, for example, from an aluminum roll coated with a polyurethane covering. The second electrode 44 is connected to high voltage source 48. The photoconductive electrode 36 is grounded thereby enabling a field to be created across the imaging suspension 42 between electrodes 44 and 36. The copy web 46 emanates from supply roller 50 and passes through a train of tension and swing rollers 52, 54, 56 and 58 and over the second electrode 44 to a web clamp 60. An idler roll 62 is provided to maintain tension on the web. This arrangement enables automatic registration of the surface of the copy web 46 with the projected image on the photoconductive electrode 40. At the end of an imaging cycle (shown in dotted lines), the second electrode 44 is lifted and caused to reverse direction thereby returning to its initial position. In this manner, three color separations can be overlaid successively in registration on a single copy web. The swing and return of the copy web presents the image on the copy web for visual inspection after each imaging cycle. At any time desired, the copy web 46 can be advanced by releasing the web clamp 60 and a brake (not shown) on the supply roll.

Back migration can be essentially eliminated in the above-described system or in other sequential electrophoretic systems by employing marking materials for use in the imaging suspension comprising particles coated, encapsulated with or embedded in a normally solid, solvent tackifiable polymer and/or a copy web impregnated or coated with a normally solid, solvent tackifiable polymer and applying to the copy web at least a partial solvent for said tackifiable polymer in an amount sufficient to render said polymer at least partially tacky before the second and before each subsequent image generating step. Thus, as shown in FIG. 2, activation of spray nozzle 64 before the second and third sequential image generating steps enables the copy web 46 to be sprayed with a solvent or partial solvent for the polymer employed with either the particles of the imaging suspension or the copy web. In this manner, the image is rendered sufficiently tacky to adhere to the copy web but not enough to effect complete fixing. Effective amounts of the solvent or partial solvent which can be employed to render the image sufficiently tacky to adhere to the copy web can be readily determined by one skilled in the art. Sufficient solvent or partial solvent must be employed to adhesively secure or bond the image to the copy web while substantially retaining intact the initial dimensions of the pigment particles. Too much solvent or partial solvent effects coalescence of the tackifiable polymer forming a liquid film in which the pigment particles are mobile resulting in agglomeration of the particles and distortion or destruction of the image. The exact amount of solvent or partial solvent employed will vary with the particular polymer and solvent employed; however, a suitable amount for use can be easily determined by simple experimentation.

Suitable normally solid, solvent tackifiable polymers which can be employed in combination with either or both of the photosensitive particles or the copy web are, for example: nitrocellulose, cellulose acetate, cellulose acetate butyrate, cellulose acetate-propionate, vinyl resins and copolymers, i.e., vinylidene chloride/acrylonitrile, vinyl chloride/vinylidene chloride, vinyl chloride/vinyl acetate, polyvinyl alcohol, polyvinyl formal and butyral, vinyl ketone, polystyrene and polystyrene copolymers and terpolymers, polyethylene, polypropylene, polycarbonates, silicone and silicone alkyds, acrylic polymers and copolymers, phenolics, epoxies, urethanes, shellac, congo copal, copal ester, rosin, ester gum maleic resins, chlorinated polyether, rubber and the like.

Solvents or partial solvents for the tackifiable polymers include polar organic solvents such as, for example: alcohols such as methyl alcohol, ethyl alcohol, iso-propyl alcohol, n-propyl alcohol, n-butyl alcohol, sec-butyl alcohol, iso-butyl alcohol, methyl iso-butyl carbinol, cyclohexanol, amyl alcohol, and methyl cyclohexanol; ketones such as acetone, methyl ethyl ketone, methyl iso-butyl ketone, methyl n-butyl ketone, ethyl n-butyl ketone, di-iso-butyl ketone, ethyl iso-amyl ketone, diacetone alcohol, mesityl oxide, iso-phorone, cyclohexanone and methyl cyclohexanone; esters such as methyl acetate, ethyl acetate, iso-propyl acetate, n-propyl acetate, n-butyl acetate, sec-butyl acetate, iso-butyl acetate, amyl acetate, methyl amyl acetate, 2-ethyl hexyl acetate, ethyl lactate, n-butyl lactate and ethylene glycol mono-ethyl ether acetate; glycol ethers such as ethylene glycol monomethyl ether, ethylene glycol monoethyl ether, ethylene glycol mon-iso-propyl ether, ethylene glycol mono-n-butyl ether, diethylene glycol monomethyl ether, diethylene glycol monoethyl ether and diethylene glycol mono-n-butyl ether; hydrocarbons such as benzene, toluene, xylene, cyclohexane, n-hexane, dipentene, turpentine, solvent naphtha, heavy naphtha and other solvents such as ethyl ether, iso-propyl ether, tetrahydrofuran, 1,4-dioxane, methylene chloride, nitromethane, nitroethane, 1-nitropropane, 2-nitropropane, dimethyl formamide, and the like.

Although the solvent on partial solvent is illustrated in FIG. 2 as being applied to the back or non-image receiving surface of the copy web 46, it is apparent that it can also be applied to the image receiving surface of the web. The solvent or partial solvent can be applied to the copy web in any convenient manner such as by spraying as shown, by swabbing, brushing, dip coating, roller coating or other similar application techniques.

In this manner, back migration of particles, whether such particles are electrically photosensitive or inert is avoided, thereby providing high fidelity color reproduction capability of electrophoretic sequential color imaging processes.

The following examples further define, describe and compare the methods of eliminating back migration in electrophoretic sequential color imaging processes in accordance with the present invention. Unless otherwise stated, all percentages and parts are by weight.

EXAMPLE I

The apparatus represented schematically in FIG. 2 is employed in this example to obtain full color prints. The light source is 750–1000 watt tungsten projection bulb. The lamp housing has a built-in cooling fan and a sliding negative holder. A movable, variable aperture lens is mounted between the two mirrors shown to provide focusing and light intensity control. Attached to this lens is a holder for 2 inches × 2 inches color separation filters and infrared cut-off filters - Corning No. 4–97 680 mμ cut-off filters. A transparent electrically conductive NESA electrode is employed and a second roller electrode consisting of a 1 ½ inches diameter aluminum roller with a 3/16 inch thick polyurethane covering thereon is also employed. The second roller electrode is connected to a high voltage source and the NESA electrode is grounded. The copy web supply and transport section of the apparatus consists of a locking brake on the supply roll and a web clamp after the roller electrode which, combined with swing and tension rolls provides automatic registration of the copy web with the projected image on the NESA electrode. At the end of an imaging pass, the imaging roller is lifted and caused to reverse direction so as to return to its initial position. In this manner, three color separations can be overlaid successively in registration on a single copy web. The copy web consists of a roll of Sterling Litho Paper available from Westvaco Corporation.

A photoconductive electrode is formed by dispersing about one part by weight of the X-form of metal-free phthalocyanine, made as shown in U.S. Pat. No. 3,357,989, in a mixture containing 3 parts of PE-200 (a polyester resin available from Goodyear Tire and Rubber Co.), about 15 parts of methyl ethyl ketone and about 10 parts of toluene. The resulting slurry is coated on a 2.0 mil Mylar film, a polyester film available from Dupont using a No. 6 wire wound rod producing a photoconductive layer of about 4–5 microns dry thickness. The resulting Mylar backed photoconductive layer is then affixed to the transparent electrically conductive NESA electrode.

A cyan color separation image is obtained by overcoating the photoconductive electrode with an ink suspension of about 2 parts by weight Lawter cyan blue-dyed resin (D-2858 HI VIZ available from the Lawter Chemicals Inc., Chicago, Illinois, and described in U.S. Pat. No. 3,361,677) and about 1 part eicosane binder and 15 parts Sohio 3454, a mixture of kerosene fractions available from Standard Oil of Ohio, using a No. 8 wire wound rod providing a 5–6 micron layer dry. The eicosane binder is dissolved with Sohio 3454 prior to imaging so that the particles are free to migrate from one electrode to the other independently of one another. Employing a Wratten No. 25 (red) color separation filter, a first imaging sequence is conducted, in the dark, using a roller speed of 1.0 inch per second, f/16 aperture setting, 110 volts on the projector lamp, 6.0 kilovolts negative on the second roller electrode. Thereafter, the copy web is allowed to air dry and the cyan imaging suspension is removed from the photosensitive electrode. When the copy web is dry, a spray of methyl ethyl ketone is applied to the underside of the copy web. Sufficient methyl ethyl ketone is applied to tack down the image but not enough to cause complete fixing. Thereafter, the image is once again allowed to air dry.

The second imaging cycle is conducted by applying a magenta imaging suspension to the photoconductive electrode. The magenta imaging suspension comprises about 2 parts of magenta-dyed resin (type R 103-6 available from the Radiant Color Co., Richmond, California), suspended in about 5 parts of Sohio Odorless Solvent 3454, a mixture of kerosene fractions available from Standard Oil of Ohio. The suspension is coated onto the photoconductive electrode using a No. 4 Mayer coating rod employing a Wratten No. 58 (green) color separation filter. Then, the imaging cycle is conducted in the dark using a second roller electrode speed of 1.0 inch per second, f/8 aperture setting, 110 volts A.C. on the projection lamp, 6 kilovolts negative on the second roller electrode. Superimposition and registration of the magenta image on the cyan image on the copy web is automatic, within the dimensional stability limits of the paper, due to the construction of the apparatus as shown in FIG. 2. The resulting superimposed image on the copy web is allowed to air dry and the magenta imaging suspension is removed from the photoconductive electrode. Thereafter, the copy web is again wetted with sufficient methyl ethyl ketone to tack down the image but not enough to cause complete fixing thereof. The copy web is again allowed to air dry.

The third and final yellow imaging cycle is effected by coating the photoconductive layer with a slurry of about 2 parts Radiant Chartreuse JST 320, available from Imperial Color and Chemical Dept., Hercules Incorporated, one part Piccotex 75 resin, about 15 parts by weight Sohio 3454 solvent using a No. 10 wire wound rod. Employing a Wratten No. 47B (blue) color separation filter, the imaging cycle is effected in the dark using a second roller electrode speed of 0.6 inch per second, f/5.6 aperture setting, 130 volts A.C. on the projector, 8.0 kilovolts positive on the roller electrode. The copy web which now contains all three colors superimposed in registration to provide a full color copy of the original is alowed to air dry and is then heat-fused to fix and transparentize the colors. Employing the above procedure and tackifying the dyed polymers of the respective imaging suspensions before the second and third imaging cycles, a high fidelity full color image is obtained with essentially no back migration.

Control

Employing the identical procedure described above but omitting the wetting of the copy web with methyl ethyl ketone before the second and third imaging cycles, it is noted that a portion of the cyan image migrates back to the magenta donor layer during the second imaging pass. This results in significant loss of saturation for the cyan color. Again, when the yellow donor is imaged, portions of both previous colors on the copy web are noted to migrate back to the yellow donor. The resulting image on the copy web exhibits a total loss of control of color balance with the final color being dominant.

EXAMPLE II

The process of Example I is repeated except that the copy web supply paper is coated with a layer of vinyl chloride/vinyl acetate copolymer resin (Bakelite VMCH vinyl resin available from Union Carbide Corporation) on the felt side of the paper to a dry film thickness of about 10 microns.

Sufficient methyl ethyl ketone is applied after the first and second imaging generating steps to tackify the polymer coating on the web thereby effecting adherence of the images in each step resulting in a high fidelity full color image with essentially no back migration.

Although specific materials and conditions were set forth in the above exemplary processes for sequentially electrophoretically generating at least visible monochromatic images and superimposing said images in registry upon a copy web to form a colored reproduction, these merely intended as illustrations of the present invention. Various other electrophoretic processes, marking materials, carrier liquids, photoconductive materials, solvent tackifiable polymers and solvents or partial solvents for said tackifiable polymers such as those listed above may be substituted in the examples with similar results.

Other modifications and ramifications of the present invention will occur to those skilled in the art upon reading the present disclosure. These are intended to be included within the scope of this invention.

What is claimed is:

1. In an electrophoretic reproduction process wherein a colored reproduction of an original is obtained by sequentially electrophoretically generating at least two visible monochromatic images, and superimposing said images in registry upon an image receiving surface to form a colored reproduction, the improvement comprising essentially eliminating back migration of particulate marking materials from the image receiving surface to the imaging suspension in the second and subsequent image generating steps by employing, in each instance, particulate marking materials comprising a solvent tackifiable polymer and a colorant and/or an image receiving surface containing a solvent tackifiable polymer, and applying to the image receiving surface at least a partial solvent for said tackifiable polymer in an amount sufficient to render said polymer at least partially tacky to adhesively secure the image to the image receiving surface while substantially retaining intact the initial dimensions of said particulate marking materials wherein said solvent is applied to the image receiving surface after each image is formed and before each subsequent image generating step.

2. The process of claim 1 wherein particulate marking materials comprising a solvent tackifiable polymer and a colorant are employed.

3. The process of claim 1 wherein the image receiving surface contains a solvent tackifiable polymer.

4. The process of claim 1 wherein cyan, magenta, and yellow images are superimposed to provide a full color reproduction.

5. The process of claim 1 wherein the solvent or partial solvent is applied to the underside of the image receiving surface.

6. The process of claim 1 wherein the superimposed images are finally fixed to the image receiving surface.

7. The process as defined in claim 2 wherein said monochromatic images are formed by a photoelectrophoretic process comprising providing a layer of an imaging suspension comprising particulate marking materials in an electrically insulating carrier liquid between a pair of electrodes at least one of which is at least partially transparent wherein said colorant is an electrically photosensitive pigment particle, subjecting said suspension to an electrical field and exposing said suspension to imagewise activating electromagnetic radiation through said transparent electrode, and wherein said image receiving surface is a surface of one of said electrodes.

8. The process as defined in claim 2 wherein said monochromatic images are formed by a photoelectrophoretic process comprising providing a layer of an imaging suspension comprising particulate marking materials in an electrically insulating carrier liquid between a pair of electrodes at least one of which is at least partially transparent, wherein said colorant is an electrically photosensitive pigment particle, subjecting said suspension to an electrical field and exposing said suspension to imagewise activating electromagnetic radiation through said transparent electrode, and wherein said image receiving surface is a receiver member interposed between the surface of one of said electrodes and said imaging suspension layer.

9. The process as defined in claim 8 wherein cyan, magenta and yellow images are superimposed to provide a full color reproduction.

10. The process as defined in claim 2 wherein said monochromatic images are formed by a process comprising providing a layer of an imaging suspension comprising particulate marking materials in an electrically insulating carrier liquid between a pair of electrodes at least one of which has a photoconductive surface and at least one of which is at least partially transparent, wherein said colorant is an inert particle, subjecting said suspension to an electrical field and exposing said photoconductive surface to an imagewise pattern of electromagnetic radiation to which it is sensitive through said transparent electrode, and wherein said image receiving surface is a surface of one of said electrodes.

11. The process as defined in claim 2 wherein said monochromatic images are formed by a process comprising providing a layer of an imaging suspension comprising particulate marking materials in an electrically insulating carrier liquid between a pair of electrodes at least one of which has a photoconductive surface and at least one of which is at least partially transparent, wherein said colorant is an inert particle, subjecting said suspension to an electrical field and exposing said photoconductive surface to an imagewise pattern of electromagnetic radiation to which it is sensitive through said transparent electrode, and wherein said image receiving surface is a receiver member interposed between the surface of one of said electrodes and said imaging suspension layer.

12. The process as defined in claim 11 wherein cyan, magenta and yellow images are superimposed to provide a full color reproduction.

13. The process as defined in claim 2 wherein said monochromatic images are formed by a process comprising providing a layer of an imaging suspension comprising particulate marking materials and electrically photosensitive pigment particles in an electrically insulating carrier liquid between a pair of electrodes at least one of which is at least partially transparent, wherein said colorant is an inert particle, subjecting said suspension to an electrical field and exposing said suspension to activating electromagnetic radiation to which said electrically photosensitive pigment particles are sensitive through said transparent electrode, and wherein said image receiving surface is a surface of one of said electrodes.

14. The process as defined in claim 2 wherein said monochromatic images are formed by a process comprising providing a layer of an imaging suspension comprising particulate marking materials and electrically photosensitive pigment particles in an electrically insulating carrier liquid between a pair of electrodes at least one of which is at least partially transparent, wherein said colorant is an inert particle, subjecting said suspension to an electrical field and exposing said suspension to activating electromagnetic radiation to which said electrically photosensitive pigment particles are sensitive through said transparent electrode, and wherein said image receiving surface is a receiver member interposed between the surface of one of said electrodes and said imaging suspension layer.

15. The process as defined in claim 14 wherein cyan, magenta and yellow images are superimposed to provide a full color reproduction.

* * * * *